United States Patent [19]

Stacher

[11] Patent Number: 4,997,010

[45] Date of Patent: Mar. 5, 1991

[54] CLOTH SUPPORT WITH CLOTH GUIDING SURFACE FOR CLOSE ENGAGEMENT WITH REED SIDE WALLS

[75] Inventor: Angelo Stacher, Arbon, Switzerland

[73] Assignee: Sulzer Brothers Limited, Winterthur, Switzerland

[21] Appl. No.: 430,724

[22] Filed: Nov. 2, 1989

[30] Foreign Application Priority Data

Nov. 10, 1988 [CH] Switzerland ..... 04174/88-4

[51] Int. Cl.[5] ..... D03D 47/30

[52] U.S. Cl. ..... 139/192; 139/188 R; 139/435.5

[58] Field of Search ..... 139/435.5, 192, 304

[56] References Cited

U.S. PATENT DOCUMENTS 4,478,259 10/1984 Honegger ..... 139/192 X
4,529,015 7/1985 Moessinger et al. ..... 139/192
4,532,965 8/1985 Lincke ..... 139/435

FOREIGN PATENT DOCUMENTS 3115213 2/1982 Fed. Rep. of Germany .
3234813 1/1984 Fed. Rep. of Germany .

*Primary Examiner*—Andrew M. Falik
*Attorney, Agent, or Firm*—Kenyon & Kenyon

[57] ABSTRACT

The reed of an air jet loom has a passage for guiding the weft yarn to be picked which in cross-section is trough-shaped with substantially parallel walls and a base which extends transversely to the walls. The cloth support extends so far into the weft-guiding passage that the shortest distance between the weft-guiding surface and the passage base is less than one-third of the average distance between the passage walls. Consequently, the cloth is guided so accurately between the weft-guiding passage and the cloth support during the beating-up of the weft yarn that a very uniform fabric is produced.

14 Claims, 2 Drawing Sheets

Fig.3
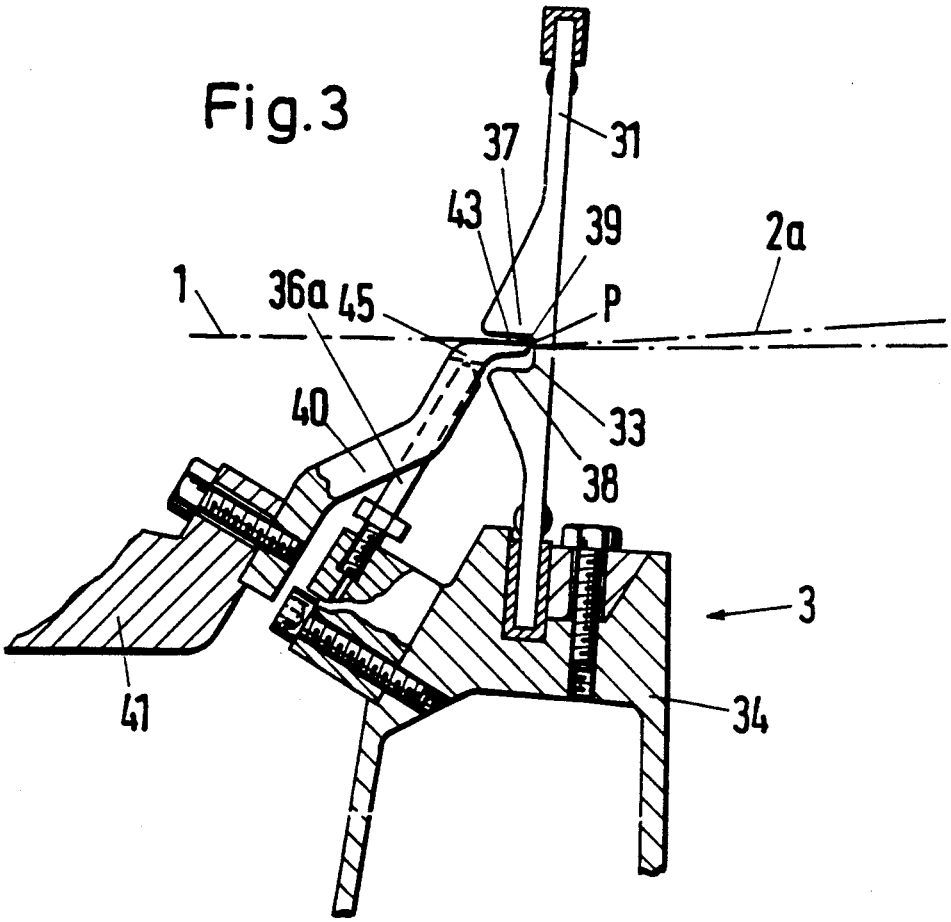
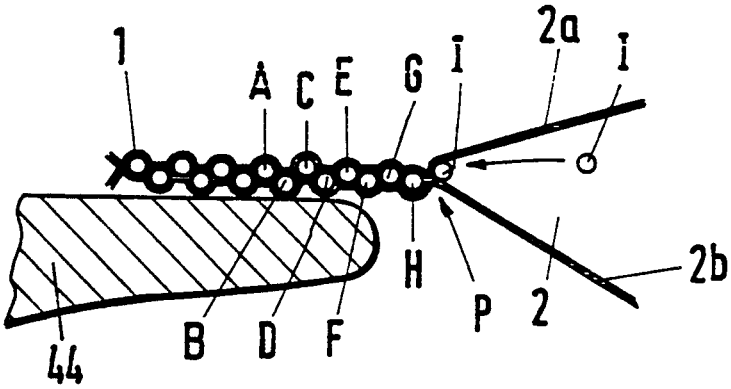
Fig.4a
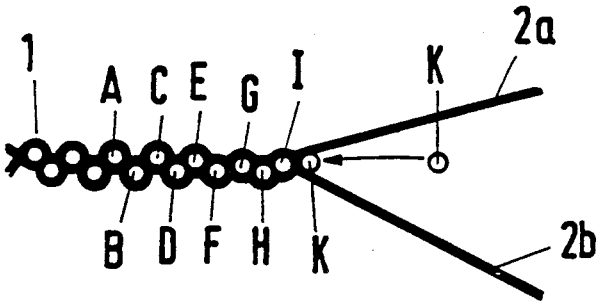
Fig.4b

CLOTH SUPPORT WITH CLOTH GUIDING SURFACE FOR CLOSE ENGAGEMENT WITH REED SIDE WALLS

This invention relates to a loom having a cloth support.

As is known, looms have been provided with a reed for the beating-up of a picked weft yarn within a shed in order to form a cloth with the weft yarns of the shed. In some cases, the reed has been mounted on a sley which can be oscillated back and forth to carry out a beating-up operation. For example, some reeds have been constructed of elongated profiled lamellae each of which is formed with a passage for guiding the weft yarn to be picked. Usually, the passage has a troughshaped cross section with a base parallel to the discrete lamellae while the walls extend substantially transversely to the base.

As is also known, looms normally have a cloth support disposed near the line on which the weft yarn is beaten up on a fell to ensure that the cloth takes up a fairly definite position relative to the reed and, therefore, that the warp yarns take up a relatively defined position relative to the picking element of the loom. For example, U.S. Pat. No. 4,532,965 illustrates a cloth support surface adjacent to the beating-up position of a weft yarn picking channel while German O.S. 3115213 illustrates a cloth support in a loom adjacent to a beating-up position.

In air jet looms which use reed constructions of the above type, the distance between the passage walls and the depth of the passage have values of the order to magnitude of ten (10) millimeters (mm) and for reasons of space, the cloth support is normally disposed adjacent the weft-guiding passage when the sley is in the beating-up position. Tests on an air jet loom have shown that, particularly in the production of very dense cloths, the relatively considerable distance between the cloth support and the beating-up line of the reed on the passage base is a disadvantage since the fell may shift along the passage base during the beating-up of the reed unless the base is dead perpendicular to the cloth and the resulting warp yarn tension is operative at an inclination to such base. One possible result of the cloth beating-up line shifting along the reed is that the weft yarns may not be taken up into the cloth uniformly, so that weft density may not be uniform.

Accordingly, it is an object of the invention to improve the cloth support of a loom having a reed embodied by profiled lamellae as to improve guidance of the cloth, particularly during beating-up.

It is another object of the invention to improve the quality of cloth formed on a loom.

It is another object of the invention to precisely control the beating up of a weft yarn into a cloth on a loom.

Briefly, the invention is directed to a loom which has a reed with a plurality of elongate profiled lamellae each of which has a trough-shaped passage for guiding a weft yarn therein during movement into a beating-up position and a cloth support for supporting the formed cloth. Each passage of a lamella has a base parallel to a longitudinal axis of the respective lamella and a pair of side walls which are perpendicular to the base. In accordance with the invention, the cloth support has a cloth guiding surface extending into the passage of each lamella when the reed is in the beating-up position.

In accordance with the invention, the cloth-guiding surface extends so far into the interior of the weft-guiding passage when the reed is in the beating-up position, i.e. the closest position to the cloth, that the shortest distance between the cloth-guiding surface and the passage base is less than one-third of the average distance between the passage walls. Cloth guidance is normally adequate if such distance is approximately 3 millimeters (mm) or less. Advantageously, the cloth support has a beak-like projection at the end near the cloth which extends into the weft-guiding passage during beating-up. The minimum distance between the cloth-guiding surface and the passage base is of the order of magnitude of 1 millimeter (mm) to definitely preclude any contact between the reed lamellae and the cloth support in the event of deformations. Optimally, the cloth-guiding surface is so adjusted relative to the yarn-guiding passage that the distance between the cloth guiding surface and the top passage wall is of the order of magnitude of 1 millimeter (mm). Advantageously, the end of the cloth-guiding surface is spherical since the cloth is deflected through a reduced angle on such a surface.

The cloth-guiding surface of the cloth support substantially obviates relative movements of the fell along the reed during beating-up of the weft yarn, so that the weft yarns are taken upon more uniformly than previously and a regular cloth structure is produced.

These and other objects and advantages of the invention will become more apparent from the following detailed description taken in conjunction with the accompanying drawings wherein:

FIG. 3 illustrates a cross sectional view of a cloth support surface constructed in accordance with the invention;

FIG. 4*a* illustrates an enlarged view of a cloth form in accordance with the invention prior to beating-up; and FIG. 4*b* illustrates a view similar to FIG. 4*a* of the cloth after beating-up of a weft thread.

Figure 1:
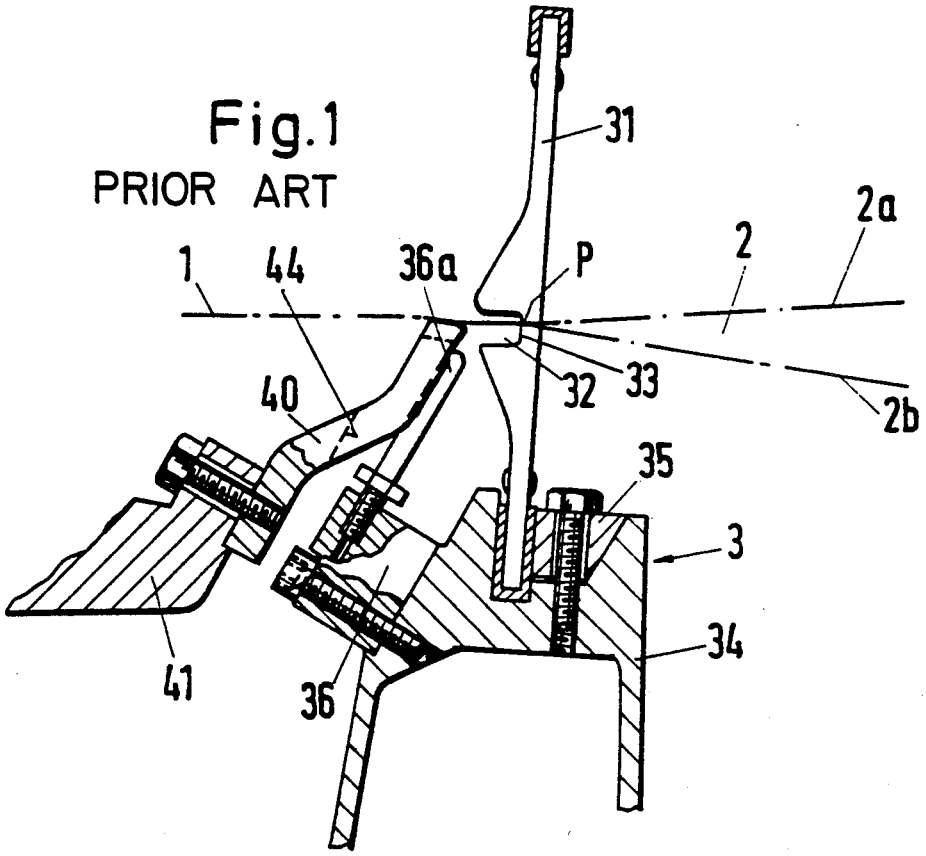
Fig.1 PRIOR ART
FIG. 1 illustrates a cross sectional view of a sley and cloth support surface in accordance with the prior art.

Referring to FIG. 1, the loom is constructed so as to form a cloth 1 from a plurality of warp yarns 2*a*, 2*b* which are delivered in a conventional manner to form a shed 2 to receive weft yarns (not shown). As indicated, a sley 3 is provided for the beating-up of the weft yarns into the cloth 1. Such a sley 3 carries a reed 31 which has a beating-up position P disposed within a trough-shaped passage 32 having a flat base 33. As indicated,the reed 31 is secured in a support structure 34 of the sley 3 by means of a clamping member 35. In addition, an auxiliary nozzle unit 36 is secured to the support structure 34 and, in turn, carries an auxiliary nozzle 36*a* as is known.

In addition, a cloth support 40 is mounted on a holder 41 of the loom frame for supporting the cloth 1 which is produced. Since the nozzle 36*a* is to be disposed within the plane of the cloth support 40 during beating-up, the support 40 is formed with slots 44 to accommodate the nozzle 36*a*.

Figure 2:
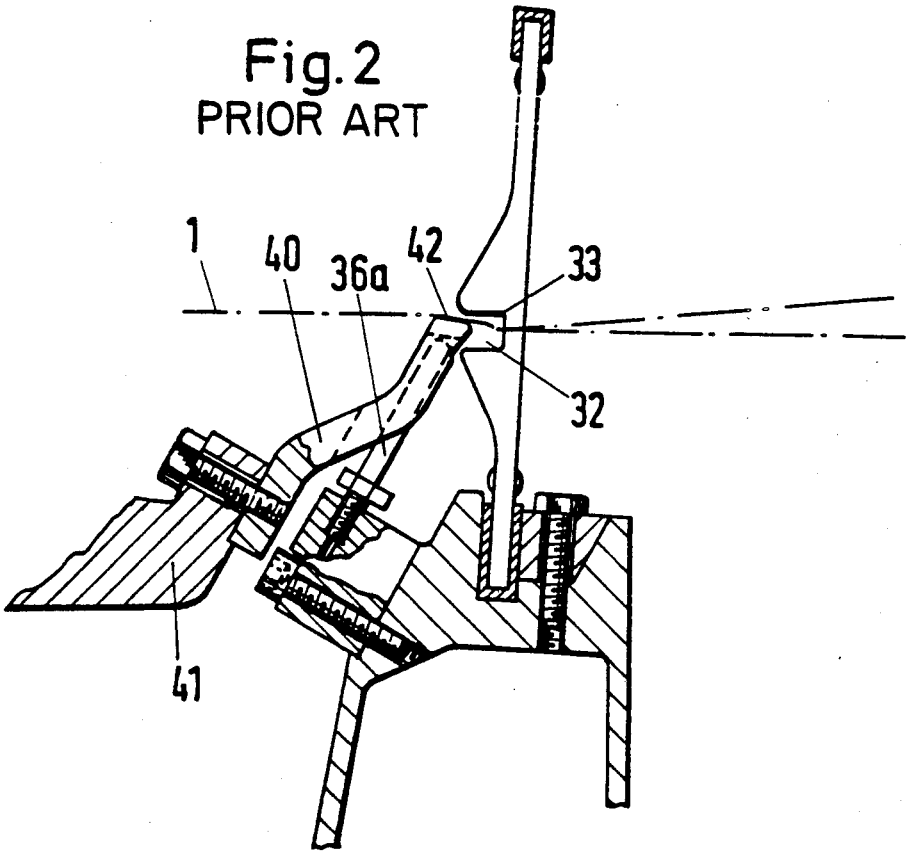
Fig.2 PRIOR ART
FIG. 2 illustrates a cross sectional view of the sley and cloth support of FIG. 1 in a beating up position.

FIG. 1 shows the sley 3 in the position in which the passage base 33 has conveyed the weft yarn (not shown) as far as the cloth beating-up line P. Beating-up of the cloth begins at this instant with a leftwards pivoting of the sley 31. The end of beating-up is shown in FIG. 2, with that end of the guide surface 42 which is near the guide passage 32 being disposed a short distance therebefore. The beating-up line P has shifted down along the passage base 33 as compared with FIG. 1. Since the position of the line beating-up line P on the passage base 33 may vary slightly between consecutive beat-ups, the conditions for the weft yarns to be beaten up vary. This may lead to uneven take-up of the weft yarns into the cloth resulting in a poor cloth yield, particularly in the case of dense cloths.

Referring to FIG. 3, wherein like reference characters indicate like parts as above, the reed 31 is composed of a plurality of parallel elongated profiled lamellae each of which is provided with a trough-shaped passage 32 having a base 33 parallel to the longitudinal axis of the respective lamella of the reed 31 and a pair of side walls 37, 38 which are parallel to each other and perpendicular to the base 33. In addition, an arcuate transition 39 is disposed between the top wall 37 and the base 33.

The cloth support 40 contains a beak-like projection 45 which provides a substantially enlarged guide surface 43 for the cloth. This guide surface 43 extends into the passage at beating-up to near the passage base 33 and is disposed only a short distance away from the top passage wall 37 i.e. an amount less than one-third of the average distance between the walls 37, 38. As indicated in FIG. 4*a*, the projection 45 may have a spherical-shaped end.

Because of the relative positions of the guide surface 43, top guide wall 37 and passage base 33, the beating-up line P is, in this case, disposed precisely at the end of the arcuate transition 39 between the wall 37 and the base 33. The cloth support prevents further sliding of the beating-up line P downwardly along the passage base 33 while the arcuate transition 39 between the top wall 37 and the passage base 33 prevents the cloth, i.e. the beating-up line P, from sliding into this transition zone. At the end of the beating-up movement of the sley 3, the cloth is therefore in an accurately defined position.

An explanation will be given with reference to FIGS. 4*a* and 4*b* of why it is precisely with dense cloths that there must be reproducible conditions between consecutive beatingsup. As will be apparent from FIG. 4*a*, which is an enlarged view of a part of the cloth and of the warp yarns 1 and 2*a*, 2*b* of Fig . 3, the weft yarns A, B, C, D, ... I, shown in white, are each slightly offset upwardly or downwardly from one another. The warp yarns 2*a*, 2*b*, shown in black, loop around the weft yarns, the normal case being that not every warp is positioned alternatively above and below adjacent weft yarns A, B in ordinary fabric textures. During beating-up, the weft yarn I is moved by the reed 31 from a position between the warp yarns 2*a*, 2*b* in the shed 2 as far as the beating-up line P to take up a position a little above the previously beaten-up weft yarn H, since the bottom warp yarns 2*b* experience much greater tension than the top warp Yarns 2*a*. Due to the considerable take-up of the warp Yarns, the weft Yarn I, like the weft yarns A, C, E, G, will subsequently take up a raised position relative to the weft yarn H.

Matters are different for the weft yarn K which is the next to be picked and beaten up. This weft yarn K will subsequently be disposed in the plane of the bottom weft yarns B, D, F, H. However, because of the tensioning of the warp yarns 2*a*, 2*b* , the weft yarn K is initially beaten up in a raised position relative to the weft yarn I. Consequently, the weft yarns reach their final position relative to the adjacent weft yarns only in the course of a number of subsequent beatings-up. The prolongation--of the weft-guiding surface 43 by means of the projection 45 towards the beating-up line P in accordance with FIG. 3 ensures that reproducible conditions exist at each weft beating-up since the beating-up line P cannot make any vertical movement, so that take-up becomes very uniform.

The invention thus provides a cloth support for a loom which is able to effectively guide a cloth which is formed, particularly during beating-up.

In addition, the invention provides a cloth support which is able to precisely control the beating up position of a weft into the cloth, that is, by precisely controlling the beating up line for the weft.

What is claimed is:

1. In a loom, the combination comprising a reed having a plurality of elongated profiled lamellae, each lamella having a trough-shaped passage for guiding a weft yearn therein during movement into a beating-up position, each said passage having a base parallel to a longitudinal axis of said respective lamella and a pair of side walls perpendicular to said base; and a cloth support for supporting a formed cloth and having a cloth guiding surface extending into said passage of each lamella with said reed in a beating-up position, said cloth guiding surface being spaced from said base of a respective lamella in said beating-up position an amount less than one-third of the average distance between said walls.

2. The combination as set forth in claim 1 wherein said cloth guiding surface is spaced from said base of a respective lamella a distance in the order of magnitude of 1 millilimeter.

3. The combination as set forth in claim 1 wherein said cloth support has a beak-like projection with said guiding surface thereon.

4. The combination as set forth in claim 3 wherein said projection has a spherical shaped end facing said base of a respective passage.

5. The combination as set forth in claim 1 wherein said cloth guiding surface is spaced from one of said walls of a respective passage a distance of the order of magnitude of one millimeter.

6. In a loom, the combination comprising a reed having at least one lamella having a passage for guiding a weft yarn therein during movement into a beating-up position, said passage having a base and a pair of walls perpendicular to said base; and a cloth support having a cloth guiding surface extending into said passage with said reed in a beating-up position, said surface being spaced from said base in said beating-up position an amount less than one-third of the distance between said walls.

7. The combination as set forth in claim 6 wherein said support has a projection extending into said passage in said beating-up position of said reed with said guiding surface thereon.

8. The combination as set forth in claim 7 wherein said projection is spaced from said base in said beating-up position a distance of one millimeter.

9. The combination as set forth in claim 8 wherein said surface is spaced from a respective wall of said passage a distance of one millimeter to receive the cloth therebetween.

10. The combination as set forth in claim 7 wherein said projection has a spherical shaped end facing said base.

11. In a loom, the combination comprising a reed having at least one lamella having a passage for guiding a weft yarn therein during movement into a beating-up position, said passage having a base and a pair of walls perpendicular to said base; and a cloth support having a projection extending into said passage in a beating-up position of said reed, said projection being closely spaced relative to said base in said beating-up position and having a surface closely spaced to one of said walls in said beating-up position to receive and guide a cloth thereon during beating-up while positioning a beatingup up line for a weft yarn at an arcuate transition between said one wall and said base.

12. The combination as set forth in claim 11 wherein said projection is spaced from said base in said beating-up position a distance of one millimeter.

13. The combination as set forth in claim 11 wherein said surface is spaced from a respective wall of said passage a distance of one millimeter to receive the cloth therebetween.

14. The combination as set forth in claim 11 wherein said projection has a spherical shaped end facing said base.

* * * * *

UNITED STATES PATENT AND TRADEMARK OFFICE

CERTIFICATE OF CORRECTION

PATENT NO. : 4,997,010

DATED : March 5, 1991

INVENTOR(S) : ANGELO STACHER

It is certified that error appears in the above-identified patent and that said Letters Patent is hereby corrected as shown below:

Column 1, line 33 change "to" to -of-
Column 1, line 52 change "as" to -so as-
Column 2, line 27 change "upon" to -so as-
Column 3, line 44 change "beatingsup" to -beatings-up-
Column 3, line 58 change "Yarns" to -yarns-
Column 3, line 59 change "Yarns" to -yarns- (both occurrences)
Column 6, lines 1 and 2 change "beatingup" to -beating-

Signed and Sealed this

Fifteenth Day of September, 1992

*Attest:*

DOUGLAS B. COMER

*Attesting Officer*

*Acting Commissioner of Patents and Trademarks*